US008246276B2

(12) United States Patent
Bower et al.

(10) Patent No.: US 8,246,276 B2
(45) Date of Patent: Aug. 21, 2012

(54) PUMPABLE CRIB BAG ASSEMBLY AND METHOD OF INSTALLATION

(75) Inventors: Joseph P. Bower, Morgantown, WV (US); Steven S. Fleagle, Syracuse, IN (US)

(73) Assignees: ABC Industries, Inc., Winona Lake, IN (US); Heintzmann Corporation, Cedar Bluff, VA (US)

( * ) Notice: Subject to any disclaimer, the term of this patent is extended or adjusted under 35 U.S.C. 154(b) by 0 days.

(21) Appl. No.: 12/932,615

(22) Filed: Feb. 28, 2011

(65) Prior Publication Data

US 2012/0009023 A1 Jan. 12, 2012

Related U.S. Application Data

(60) Provisional application No. 61/399,296, filed on Jul. 9, 2010.

(51) Int. Cl.
*E21D 15/00* (2006.01)

(52) U.S. Cl. ..... 405/289; 405/288; 405/272; 299/11

(58) Field of Classification Search ..... 405/288, 405/289, 272, 273; 299/11, 12
See application file for complete search history.

(56) References Cited

U.S. PATENT DOCUMENTS

| | | | | |
|---|---|---|---|---|
| 5,143,340 | A | 9/1992 | Wood et al. | |
| 5,308,196 | A | 5/1994 | Frederick | |
| 6,547,492 | B1 | 4/2003 | Degville | |
| 2005/0070187 | A1 * | 3/2005 | Cavenagh | 442/185 |
| 2007/0231085 | A1 | 10/2007 | Skarbovig | |
| 2010/0104376 | A1 * | 4/2010 | Skarbovig | 405/232 |
| 2010/0135732 | A1 | 6/2010 | Skarbovig | |
| 2010/0209023 | A1 * | 8/2010 | Skarbovig | 383/105 |
| 2010/0247249 | A1 | 9/2010 | Skarbovig | |

FOREIGN PATENT DOCUMENTS

| | | | |
|---|---|---|---|
| GB | 2091314 A | * | 7/1982 |
| GB | 2131850 A | * | 6/1984 |
| WO | WO 9106746 A1 | * | 5/1991 |
| WO | WO 2009010863 A2 | * | 1/2009 |
| WO | WO 2009053797 A2 | * | 4/2009 |

* cited by examiner

*Primary Examiner* — Frederick L Lagman
(74) *Attorney, Agent, or Firm* — Carothers & Carothers

(57) ABSTRACT

A pumpable inflatable crib bag assembly for supporting a mine roof which includes a generally cylindrical bag having top and bottom ends for retaining and confining a liquid settable grout to be pumped into the bag. The bag further includes an inner generally cylindrical mesh reinforcement disposed within and generally coextending with the bag. This generally cylindrical mesh reinforcement is spaced from an inner wall of the bag and is permeable to the liquid settable grout whereby the liquid settable grout may be pumped through a fill port into the bag to thereby fill the bag and encapsulate the mesh reinforcement. The liquid settable grout is pumped through a fill port which is adjacent the top end of the bag.

17 Claims, 4 Drawing Sheets

PUMPABLE CRIB BAG ASSEMBLY AND METHOD OF INSTALLATION

CROSS REFERENCE

This application claims the benefit of U.S. Provisional Application No. 61/399,296, filed Jul. 9, 2010, entitled PUMPABLE CRIB BAG WITH INNER REINFORCEMENT BAG, the contents of which are incorporated herein in their entirety.

BACKGROUND OF THE INVENTION

The present invention relates to a grout bag, sometimes referred to as an inflatable bag, for use in mine support and also to a method of installing the support.

Such grout bags are used to support the hanging wall or roof in underground mining operations relative to the footwall or floor. The grout bags generally are filled with a liquid settable grout which sets solid using cementitious or other suitable binding material.

Props have been used for supporting the mine roof for many years. More recently inflatable grout bags have been employed as mine props whereby they are positioned in a deflated condition with the upper end thereof secured to the mine roof. The bag is then inflated to a substantial pressure with a settable grout and thereafter permitted to cure.

Such grout bags are also referred to as pillar bags and they are generally supported and reinforced over their vertical length by metal hoops or other reinforcing structure against expansion in the traverse direction when filled with a liquid settable material.

Problems incurred with existing grout bags are that they are generally expensive because of the associated elaborate reinforcing structures employed and further because considerable labor is involved in their erection. Additionally, reinforced grout bags of the prior art have insufficient load carrying capacity. Such prior art grout bags usually have a residual load capacity of approximately 250 kips to 300 kips, 125 tons to 150 tons, with about 9" of displacement. It is a principal object of the present invention to provide a pumpable crib bag having a residual load capacity which is exceptionally greater.

SUMMARY OF THE INVENTION

The pumpable crib bag assembly of the present invention includes a generally cylindrical bag having closed top and bottom ends for retaining and confining a liquid settable grout to be pumped into the bag. An inner generally cylindrical mesh reinforcement is disposed within and generally coextends with the bag. This generally cylindrical mesh reinforcement is spaced from the inner wall of the bag and is permeable to the liquid settable grout whereby the liquid settable grout may be pumped through a fill port into the bag to thereby fill the bag and encapsulate the mesh reinforcement. The fill port is provided adjacent the top end of the bag. If the bag is constructed of material which is non-permeable to air, an air escape port is provided at the top end of the bag. Even in situations where the bag is permeable to air, such an air escape port may nevertheless be required in the event that the bag fabric is constructed of a tight weave wherein escape of air therethrough is considerably slowed.

The fill port for the liquid settable grout extends into the interior of the mesh reinforcement and includes a one-way valve to prevent the liquid settable grout from exiting the bag from the fill port when the bag is completely filled under pressure.

The bag and the internal mesh reinforcement include external reinforcement retainers for reinforcing the bag and the mesh reinforcement in order to minimize lateral bulging. The bag together with its internal mesh reinforcement is axially collapsible for storage, transportation and for adaptable inflatability which permits the bag to expand and adjust to the required support dimension between the mine roof and floor upon inflating the bag by pumping liquid settable grouts therein. The retainer reinforcement for the bag and the inner mesh reinforcement is provided in a preferred embodiment in the form of a spiral wire reinforcement or spaced wire hoops in order to permit collapsibility of the structure. The inner mesh reinforcement is typically constructed of a plastic mesh, but can be constructed from other materials such as wire mesh with open interstices, woven or weft-inserted polyolefin products and polyester. Such materials allow the permeation or passage of the liquid settable grout, which may or may not be further reinforced with a wire, cable or ring-type retainer.

The bag may be composed of fabric, plastic or fabric reinforced plastic, and may be permeable to liquid or not depending upon the liquid settable grout selected.

In an preferred embodiment, the liquid settable grout is selected as calcium sulphoaluminate cement and the bag is constructed of water impervious material. Other liquid settable grouts may be selected, such as Portland/flyash cement, cellular cement, polyurethane foams, etc., and the permeability of the bag material will be selected to be compatible with the liquid settable grout selected.

In application, the upper end of the cylindrical grout bag is secured to the mine roof and then filled with the liquid settable grout while purging air from the bag. The liquid settable grout is pumped into the bag under pressure to a predetermined limit for thereby prestressing the bag between the mine roof and the mine floor.

BRIEF DESCRIPTION OF THE DRAWINGS

Other objects and advantages appear hereinafter in the following description and claims. The accompanying drawings show, for the purpose of exemplification, without limiting the scope of the invention or the accompanying claims, certain practical embodiments of the present invention wherein:

DETAILED DESCRIPTION OF A PREFERRED EMBODIMENT

Figure 1:
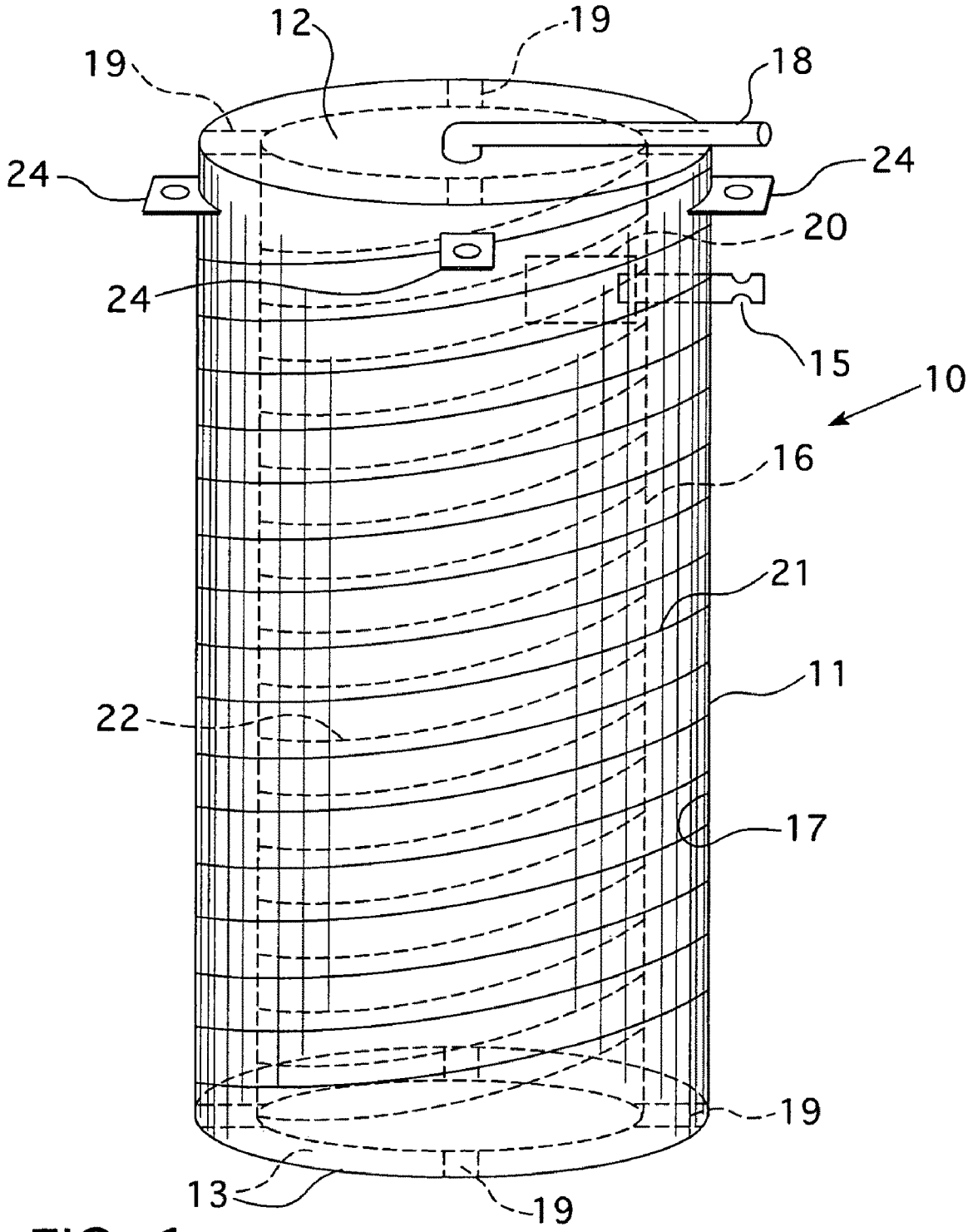
FIG. 1 is an isometric schematic representation of the pumpable crib bed assembly of the present invention in front elevation.
Figure 3:
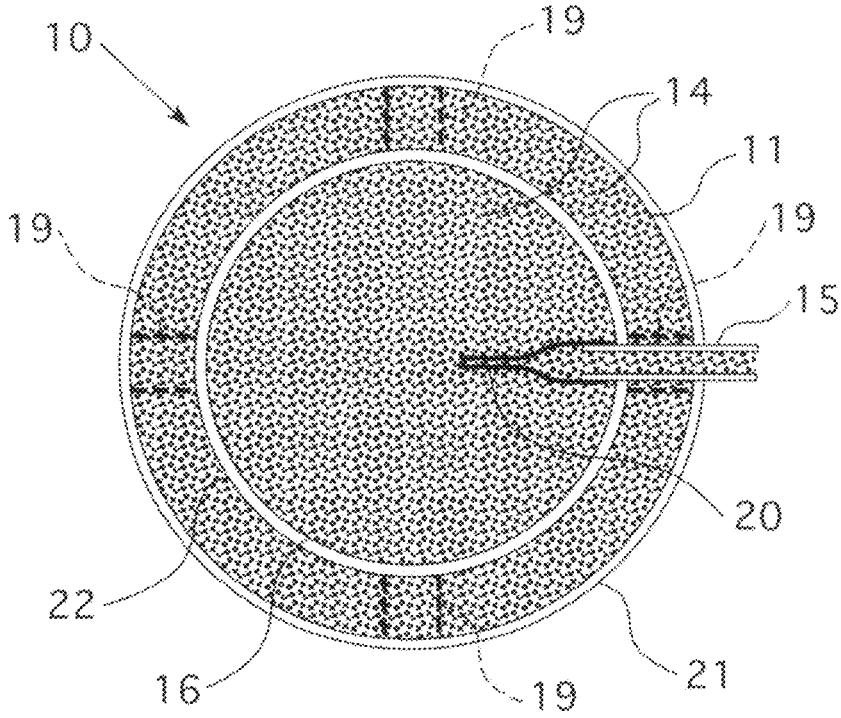
FIG. 3 is a schematic plan view in horizontal cross section of the pumpable crib bag assembly shown in FIGS. 1 and 2 as seen along section line III-III.

Referring to FIG. 1, the pumpable crib bag assembly 10 of the present invention includes a generally cylindrical bag 11 having top and bottom ends 12 and 13 respectively for retaining and confining a liquid settable grout 14 (see FIG. 3) to be pumped therein under pressure through grout fill port 15. The pumpable crib bag assembly 10 of the present invention further includes inner generally cylindrical mesh reinforcement 16 illustrated in broken lines, which generally coextends with bag 11. Mesh reinforcement 16 is spaced from the inner wall 17 of bag 11 by upper and lower spacing support straps 19. Cylindrical mesh reinforcement 16 is constructed of a permeable plastic mesh so that the liquid settable grout 14 will pass therethrough. The liquid settable grout 14 is pumped through fill port 15 into bag 11 to thereby fill bag 11 and also entirely encapsulate mesh reinforcement 16. Fill port 15 is provided adjacent the top end of bag 11 in order to easily fill bag 11 without undue back pressure of the liquid settable grout being created at the location of the fill port 15.

The bag 11 in this embodiment is constructed of non-permeable material, which is non-permeable to air and liquids, which is PVC laminate bonded with a polyester substrate fabric, but can be constructed of PVC coated fabrics with various substrates or non-permeable polyolefin products. Depending upon the liquid settable grout 14 to be selected, the fabric of bag 11 may be alternatively composed of a breathable fabric, such as a geotextile fabric.

In the embodiment illustrated, the liquid settable grout 14 is selected as calcium sulphoaluminate cement. However, other fillers or settable grouts may be utilized, such as Portland/flyash cement, cellular cement and polyurethane foams.

Since bag 11 is non-permeable to air and liquid, it includes an air escape port 15 at the top end 12 to exhaust an internal air as bag 11 is being filled with liquid settable grout 14 through port 15.

Fill port 15 extends into the interior of mesh reinforcement 16 and includes a one-way valve 20 to prevent the liquid settable from exiting the bag 11 from fill port 15 when bag 11 is filled and the liquid settable grout 14 is being pumped therein under pressure to prestress bag 11. One-way valve 20 is constructed of an impervious plastic fabric envelope attached to the distal end of the fill tube of fill port 15 whereby the liquid settable grout is permitted to pass into the interior of bag 11 and cylindrical mesh reinforcement 16. Once the bag 11 is filled and mesh reinforcement 16 is encapsulated, back pressure of the liquid settable grout within bag 11 will press against the fabric of one-way valve 20 to compress the same, thereby causing it to act as a one-way valve which prevents the grout 14 from pressuring back through port 15.

Bag 11 is provided external reinforcement retainer wire 21, of various pitches, which spirally encompasses bag 11 and is bonded to or secured to bag 11. Bonding methods include embedding the wire or cable in overlap seams of the fabric of which bag 11 is constructed, encapsulating the wire or cable under a separated strip of fabric bonded to bag 11, or attaching other types of reinforcement material to provide external reinforcement to retain bag 11 against undue bulging in the transverse direction as it is being filled, or when being compressed under actual use after completion of the installation.

Similarly, internal cylindrical mesh reinforcement 16 is constructed of a grout permeable plastic mesh, such as PVC coated mesh, but can be constructed from other open interstice materials such as wire mesh, woven or weft-inserted polyolefin products and polyester. The internal cylindrical mesh reinforcement 16 is also provided with an external retainer 22 in the form of spiraling wire encompassing the exterior of inner reinforcement 16. Reinforcing wire 22 is bonded to or secured within the spiral overlap construction seams of the mesh of reinforcement 16. Bonding methods include embedding the wire or cable in overlap seams of the mesh of which internal mesh reinforcement 16 is constructed, encapsulating the wire or cable under a separated strip of mesh bonded to internal mesh reinforcement 16, or attaching other types of reinforcement material to provide internal reinforcement to retain internal mesh reinforcement 16 against undue bulging in the transverse direction when being compressed under actual use after completion of the installation.

Figure 2:
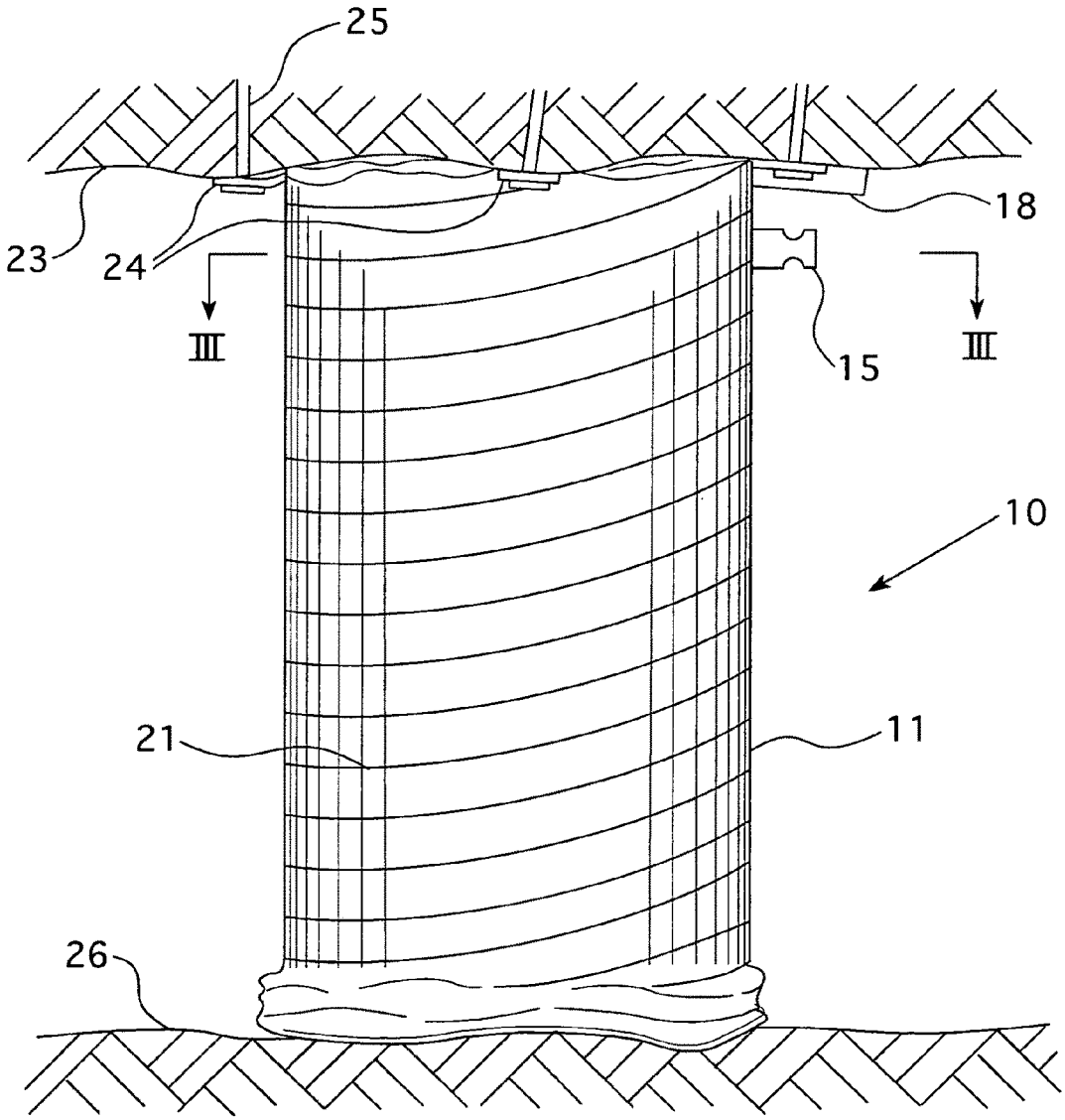
FIG. 2 is a schematic view in front elevation of the pumpable crib bag assembly shown in FIG. 1 in application between an underground mine roof and floor.
Figure 4:
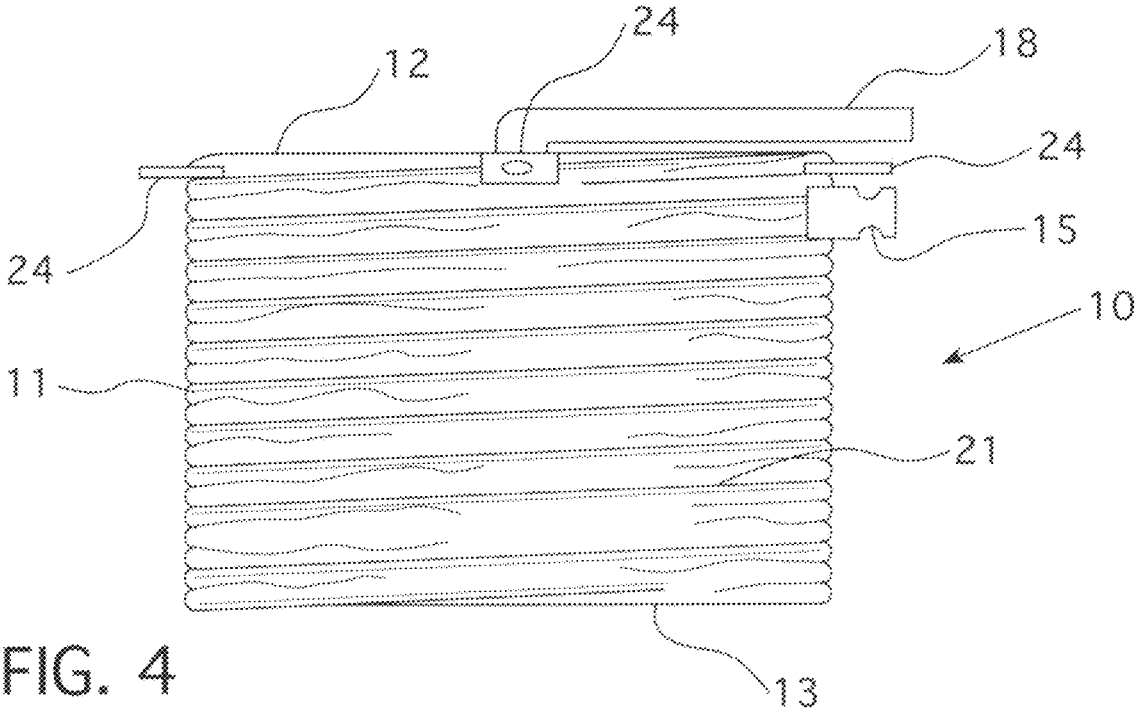
FIG. 4 is a schematic view in front elevation of the pumpable crib bag assembly shown in FIG. 1 in a collapsed condition for transportation and storage prior to application.

The construction of pumpable crib bag assembly 10 is such that it is axially collapsible for easy storage and portability as illustrated in FIG. 4. When the pumpable crib bag assembly 10 is ready to be installed within the mine, the upper end 12 of bag 11 is secured against the mine roof 23 as seen in FIG. 2 by means of the four securement tabs 24 secured adjacent to the upper end 12 of bag 11. Securement spikes as seen in FIG. 2 are driven through the securement tabs 24 into the mine roof 23 as illustrated in FIG. 2 with hand drivers. In the event that the securement spikes 25 cannot be readily driven into the mine roof 23 or the material of the mine roof 23 will not securely hold the retaining spikes 25, the top end 12 of bag 11 may be temporarily secured against mine roof 23 by the use of telescopic spring biased jack poles (not shown) which compress securement tabs 24 against mine roof 23. Such spring loaded telescopic jack poles are expanded under spring bias between the mine floor 26 and each securement tab 24. After the liquid settable grout has cured and set, the spring biased jack poles may then be removed.

After the grout bag 11 has been secured to the mine roof 23 as illustrated in FIG. 2, the upper remaining top portion of bag 11 is permitted to hug the contours of mine roof 23 and air escape port 18. As bag 11 is being filled with liquid settable grout 14 through fill port 15, bag 11 expands or inflates downwardly to engage mine floor 26 and the bottom end of bag 11 remains collapsed to fill the distance between mine roof 23 and mine floor 26 and to further fit or follow the contours of mine floor 26.

Bag 11 is filled under pressure to a predetermined limit with the liquid settable grout, such as 20 psi, for thereby prestressing the bag between the mine roof 23 and mine floor 26, the air escape port 18 being shut off at the time when grout begins to exit port 18, whereby the bag 11 is accordingly prestressed.

For alternate embodiments, the reinforcement retainer 21 and 22 need not necessarily be spiraled wire and may instead consist of wire mesh, wire hoops, cable or chain link fencing which may be preferably provided in collapsible form. Other embodiments may include non-wire reinforcements such as woven polyolefin products and high-strength polyester-substrate fabrics and meshes.

The pumpable crib bag assembly 10 of the present invention can be provided in a number of diameters for different applications from 24 to 48 inches, with the typical diameter being about 30 inches.

The pumpable crib bag assembly 10 of the present invention provides an ultimate support column which has increased initial strength and considerable residual strength over extended amounts of convergence as compared to those of the prior art. In witness of this, reference is made to the graph of FIG. 5, which illustrates actual test results of the pumpable crib bag assembly of the present invention. These test results were conducted with a roof simulator on a specimen of the present invention which was 30" in diameter and 72" high with an internal cylindrical reinforcement cylinder 16 which was 27" in diameter. The wire reinforcement 16 and 21 of inner reinforcement 16 and bag 11 was provided on a 4" pitch.

Figure 5:
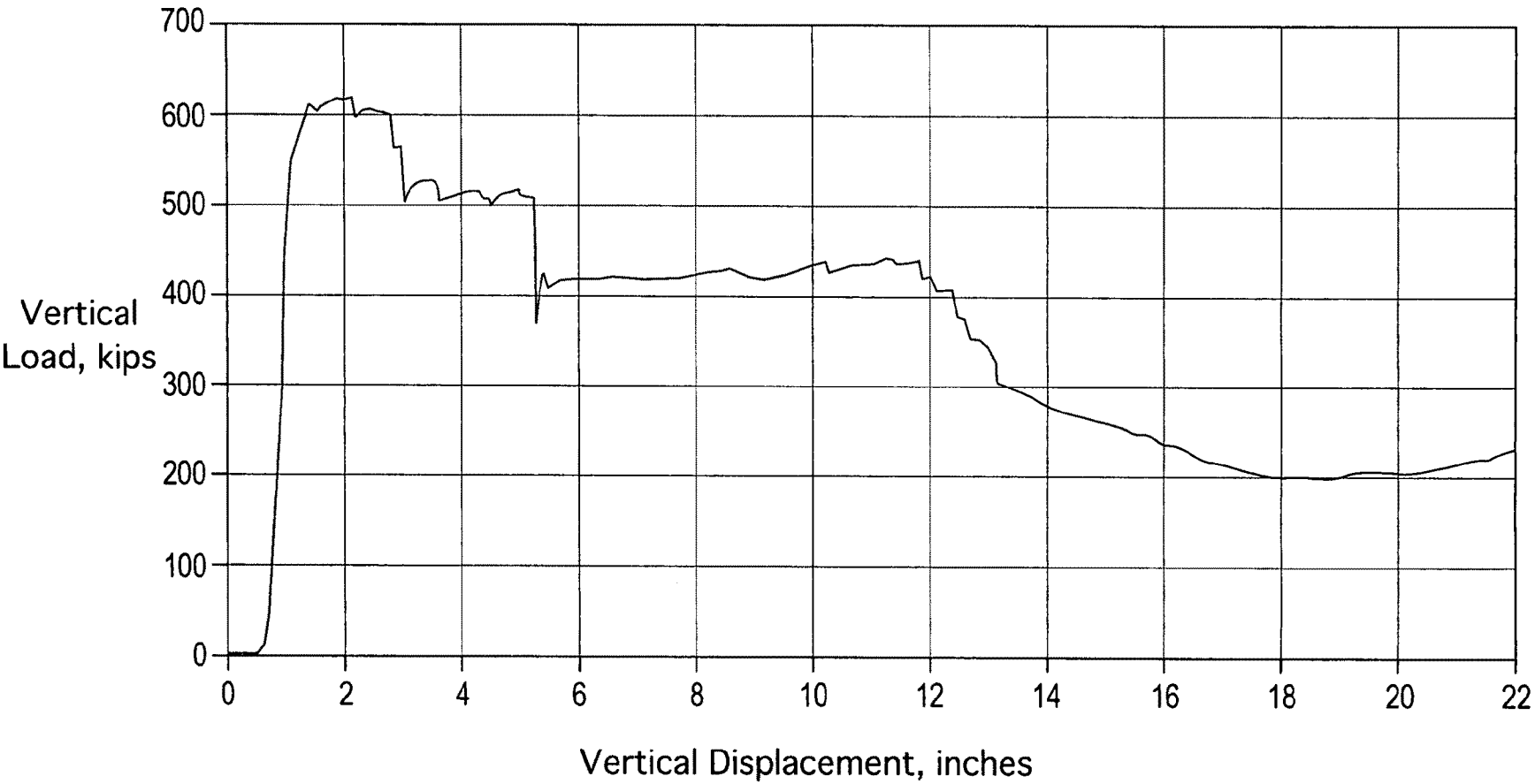
FIG. 5 is a graphical presentation of the performance of the pumpable crib bag assembly of the present invention as conducted in lab conditions with a roof simulator.

As can be seen from the graphic results in FIG. 5, the pumpable crib bag assembly 10 of the present invention tested out to about 600 kips or 300 tons, as compared to the standard inflatable crib bags which usually tests out to about 500 kips or a 250 ton rating after about ½" of displacement. After the standard inflatable or pumpable cribs reach their peak load at around ½" displacement, there is a drop in their load carrying capacity. The standard bags of the prior art usually have a residual load capacity of around 250 kips to 300 kips, 125 tons to 150 tons, for about 9" of displacement. The pumpable crib bag assembly of the present invention has a residual load capacity of around 400 kips to 425 kips, 200 tons to 212 tons, for approximately a displacement of 12".

At approximately 11" of displacement, the standard crib bag usually starts to rip open and the cured filler grout starts to fall out. When this happens the load carrying capacity starts to drop and the crib is no longer a viable roof support. Under the shown test results for the pumpable crib bag assembly of the present invention, displacement was conducted out to 22" and not only was the crib bag assembly of the present invention still maintaining a load carrying capacity of over 300 kips, 150 tons, as can be seen it was starting to climb. These features indicate that the pumpable crib bag assembly of the present invention provides dramatic improvement over the standard inflatable crib bags.

We claim:

1. A pumpable crib bag assembly comprising:

a generally cylindrical bag having top and bottom ends for retaining and confining a liquid settable grout to be pumped therein;

an inner generally cylindrical mesh reinforcement disposed within and generally coextending with said bag, said generally cylindrical mesh reinforcement spaced from an inner wall of said bag and permeable to the liquid settable grout whereby the liquid settable grout may be pumped through a fill port into the bag to thereby fill the bag and encapsulate said mesh reinforcement; and said fill port adjacent the top end of said bag.

2. The pumpable crib bag assembly of claim 1, wherein said bag is non-permeable to air and includes an air escape port at said top end.

3. The pumpable crib bag assembly of claim 2, wherein said fill port extends into the interior of said mesh reinforcement and includes a one-way valve to prevent liquid settable grout from exiting said bag from said fill port.

4. The pumpable crib bag assembly of claim 1, wherein said mesh reinforcement includes plastic mesh with wire retainer reinforcement.

5. The pumpable crib bag assembly of claim 1, wherein said liquid settable grout is cement.

6. The pumpable crib bag assembly of claim 1, wherein said bag and mesh reinforcement are axially collapsible.

7. The pumpable crib bag assembly of claim 6, including roof securement tabs extending outwardly from the bag adjacent the top end thereof for securing said bag to a mine roof.

8. The pumpable crib bag assembly of claim 1, said bag and said mesh reinforcement including external reinforcement retainers for reinforcing said bag and said mesh reinforcement.

9. The pumpable crib bag assembly of claim 8, wherein said bag and mesh reinforcement are axially collapsible, said retainers comprised of spiraling wire respectively encompassing the exterior of said bag and said mesh reinforcement.

10. The pumpable crib bag assembly of claim 1, wherein said bag is composed of fabric, plastic or fabric reinforced plastic.

11. The pumpable crib bag assembly of claim 1, wherein said inner mesh reinforcement includes plastic mesh.

12. The pumpable crib bag of claim 1, wherein the liquid settable grout is cement.

13. The pumpable crib bag of claim 12, wherein the cement is calcium sulphoaluminate cement, and said bag is water impervious.

14. The method of constructing a mine support crib for providing support between a mine roof and a mine floor, comprising:

positioning a generally cylindrical grout bag with closed ends and a spaced internal co-extending generally cylindrical mesh reinforcement end to end between said opposing mine surfaces, filling said bag with a liquid settable grout and thereby encapsulating said mesh reinforcement, and permitting said settable grout to set.

15. The method of claim 14, reinforcing said bag and said mesh reinforcement prior to filling by providing the exteriors thereof with a reinforcement retainer.

16. The method of claim 14, including purging said bag of air while filling and thereafter continuing to fill said bag under pressure to a predetermined limit for thereby prestressing said bag between said mine roof and mine floor.

17. The method of claim 14, including securing an upper end of said bag to said mine roof prior to filling.

* * * * *